United States Patent [19]

Riordan

[11] 4,103,369

[45] Aug. 1, 1978

[54] INFLATABLE STRUCTURE

[76] Inventor: David B. Riordan, 3115 Eton Ave., Berkeley, Calif. 94705

[21] Appl. No.: 772,452

[22] Filed: Feb. 28, 1977

[51] Int. Cl.[2] ..... E04H 3/16; E04H 3/18

[52] U.S. Cl. ..... 4/172.12; 52/2; 135/1 R

[58] Field of Search ..... 4/172, 172.11, 172.12; 52/2; 135/1

[56] References Cited

U.S. PATENT DOCUMENTS

| | | | |
|---|---|---|---|
| 3,224,150 | 12/1965 | Burtoff et al. | 52/2 |
| 3,250,024 | 5/1966 | Douthitt et al. | 52/2 X |
| 3,254,457 | 6/1966 | Gedney | 52/2 |
| 3,335,529 | 8/1967 | Gedney | 52/2 |
| 3,629,875 | 12/1971 | Dow et al. | 4/146 |
| 3,769,763 | 11/1973 | Kwake | 52/2 |
| 3,810,262 | 5/1974 | Strand | 4/172.12 |
| 4,000,749 | 1/1977 | Busco | 4/172.12 |

*Primary Examiner*—Henry K. Artis

*Attorney, Agent, or Firm*—Limbach, Limbach & Sutton

[57] ABSTRACT

A portable, inflatable structure comprises an inflatable enclosure, a blower for supplying pressurized air to fill the enclosure through a conduit joining the blower to the enclosure interior, vent means positioned adjacent the attachment of the upper portion of the enclosure to the floor portion thereof and a carrying case containing the blower and into which the other portions of the structure may be inserted for carrying when the enclosure is deflated.

12 Claims, 6 Drawing Figures

INFLATABLE STRUCTURE

BACKGROUND OF THE INVENTION

In numerous situations, it is desirable to be able to provide a separate, completely enclosed space within a larger room. One example of such a situation arises in the context of the widely used "open classroom" concept in which a number of students are engaged in widely varying activities all within the same room. For example, some children may be reading while others are engaged in handicrafts while still others are receiving direct instruction either from the teacher or by means of audiovisual aids. In such a situation, it is desirable to place the students receiving the direct instruction into a separate, enclosed area in order to minimize the distraction to them by the other activities in the room. Certain prior structures commercially known as the "Tunnel of Fun" and the "Develo Playhouse" have been directed towards this requirement. However, those structures, requiring a rigid support frame, also require substantial time and tools for assembly and disassemby. Thus, where the structure was desired to be used by children, it was necessary that an adult be available whenever such structure was to be assembled or disassembled. Such requirements compromised the usefulness of the structure since it was generally desirable to erect or remove the structure quickly and without tools and without any skilled supervision.

One approach to providing a readily erectable structure has been through the use of inflatable devices, such as those disclosed in patents to Burtoft et al, U.S. Pat. No. 3,224,150, Douthitt et al, U.S. Pat. No. 3,250,024, Duquette, U.S. Pat. No. 3,256,895, Gedney, U.S. Pat. No. 3,335,529, and Dowe, U.S. Pat. No. 3,629,875.

However, structures similar to the ones disclosed in those patents are generally unsuitable for use in a readily storable and erectable room divider either because of the large rigid members required by each of those structures or by the small size limitations on the structure reasonably obtainable from those teachings, as in the Burtoft et al and the Dowe patents. Thus, heretofore, there has been no fully satisfactory room dividing structure which may be readily erected or dismantled and stored and which can comfortably accommodate a number of people within.

SUMMARY OF THE INVENTION

To solve the foregoing problems, it is an object of the present invention to provide a readily portable structure for providing a separate completely enclosed space within a room. It is a further object of the invention to provide such a structure which is self-ventilating and provides for introduction of fresh air into the interior of the structure and exhausting of stale air therefrom. It is a further object of the invention to provide such a structure which is inflatable by means of a blower and which, when deflated, may be completely self-contained within a carrying case including a blower and all other portions of the structure.

Briefly, this invention is directed to a portable, self-ventilating inflatable enclosure assembly for providing a separate, completely enclosed space within a room, defined by the interior of the structure. This enclosure includes a floor portion of flexible sheet material and an upper portion also of flexible sheet material attached to the floor portion adjacent its periphery with a space between the floor portion and the upper portion defining the interior space of the enclosure. A blower is provided for supplying air at a predetermined rate at greater than ambient pressure to fill the enclosure's interior space and thus to inflate the structure, with a conduit joining the blower to the enclosure interior for introduction of the supplied air to the interior. Vent means are provided adjacent the attachment of the upper portion to the floor portion to provide for automatic venting of the supplied air from the enclosure interior at a predetermined rate once the structure is fully inflated. Also, a carrying case containing the blower is provided, into which the floor portion, upper portion, conduit and vent means are insertable for carrying when the enclosure is deflated. In a preferred embodiment of this invention, the venting means comprise a strip of open mesh interposed between the floor portion and the upper portions of the structure. Also, a selectively openable and closable slit type entrance is provided, and in a preferred embodiment, a transparent window is provided in the side of the structure with a transparent cupola projecting above the top of the structure.

BRIEF DESCRIPTION OF THE DRAWINGS

A preferred embodiment of the invention will be discussed in detail below in which.

DESCRIPTION OF A PREFERRED EMBODIMENT

Figure 1:
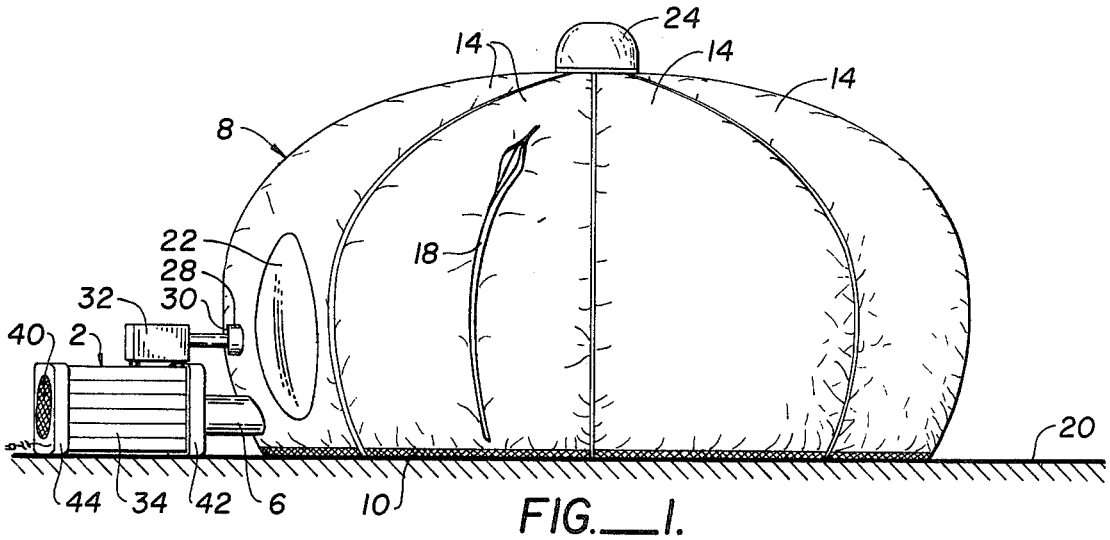
FIG. 1 is a side elevation of the erected, inflated assembly of this invention.
Figure 2:
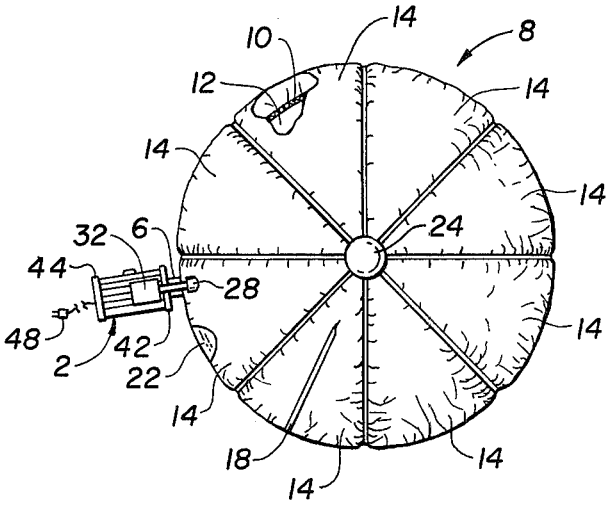
FIG. 2 is a plan view, at slightly smaller scale, of the assembly of FIG. 1.
Figure 3:
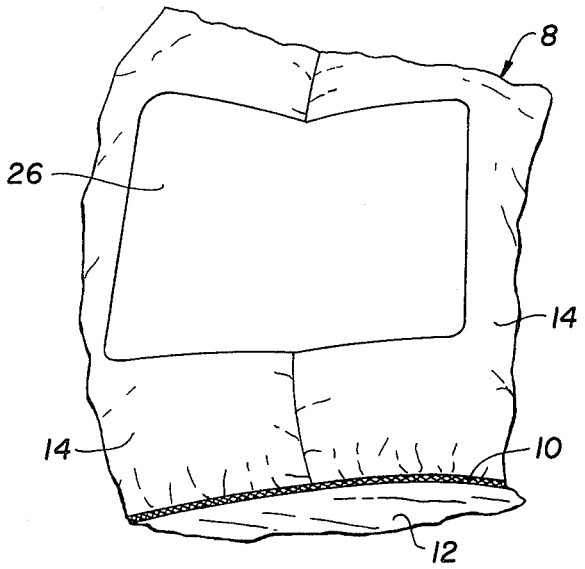
FIG. 3 is a fragmentary sectional view of the projection screen provided from an interior surface of the structure of FIG. 1.

A particularly preferred embodiment of the inflatable enclosure assembly of this invention is illustrated with the enclosure in its inflated, erected form in the side elevation of FIG. 1 and the plan view of FIG. 2 (at a smaller scale than FIG. 1) which has a small section broken out to illustrate the attachment of the floor of the structure to its upper portion.

In this embodiment the basic components, illustrated in FIGS. 1 and 2, comprise the carrying case 2, housing an electrically driven blower 4 (FIG. 4) which is attached to a hollow conduit 6 which, in turn, is attached to the upper portion 8 of the inflatable portion of the enclosure and which communicates with the interior thereof. This upper portion 8 of the inflatable enclosure is generally dome-shaped and circular in plan and is attached about its lowermost extremity to an elongated mesh vent strip 10 which, in turn, is attached to the floor portion 12 (FIG. 2). Thus, the blower 4, acting through conduit 6, may serve to introduce air at a pressure greater than ambient into the interior of the enclosure. This pressurized air within the interior of the enclosure and acting outwardly serves to inflate the enclosure and is the sole means of supporting it.

Figure 6:
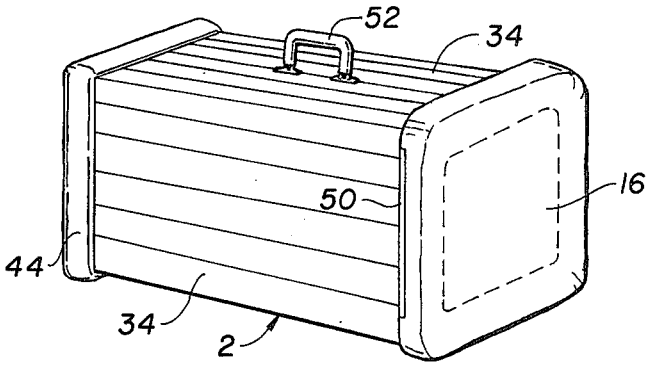
FIG. 6 is a perspective view of the structure of FIG. 5 in which the inflatable room divider is fully packed into the carrying case.
Figure 5:
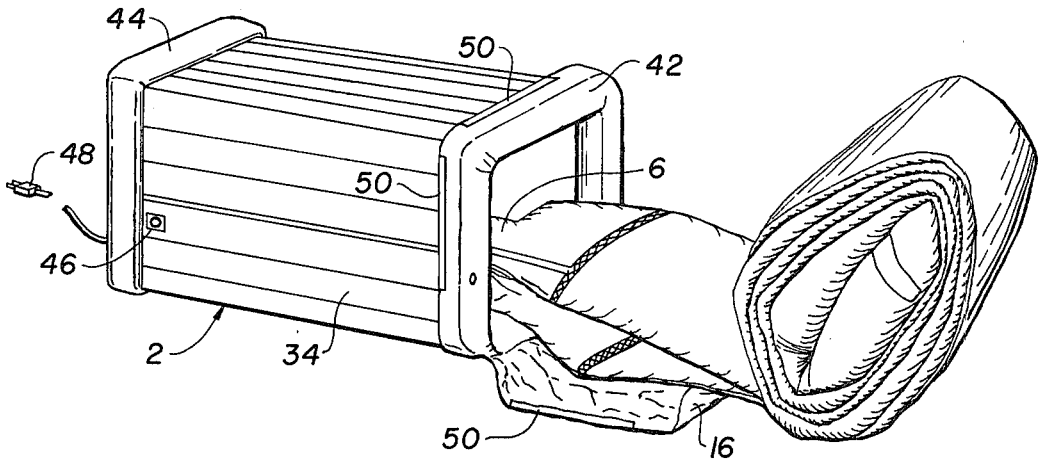
FIG. 5 is a perspective view of the structure of FIG. 1 deflated and partially rolled for packing within the carrying case.
Figure 4:
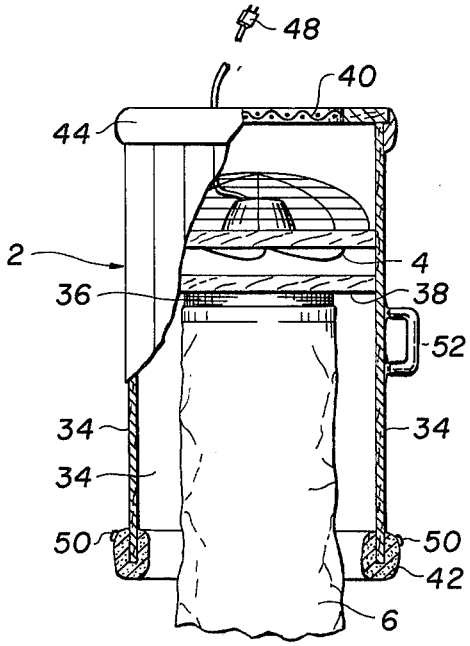
FIG. 4 is a top sectional view of the carrying case of the structure of FIG. 1.

Upper portion 8 suitably is fabricated from a plurality of shaped gores 14 of a suitable material such as ripstop nylon sewn together along their mating edges to form a single-wall structure. Suitably, the floor 12 and the hollow conduit 6 may also be formed of a similar nylon material. As illustrated in FIG. 4, the conduit 6 is attached to the carrying case adjacent the output side of the blower 4 and, as illustrated in FIGS. 5 and 6, the entire inflatable enclosure when deflated, may be rolled up and contained within the carrying case 2, with a closure flap 16 closing the end of the case by attachment with strips of a fastening material, such as Velcro, about the edges of the flap 16 and case.

An entranceway 18 extending vertically up one of the upper portion gores 14 from adjacent the floor is provided for access to the interior of the inflated structure. Suitably, this entrance 18 comprises a slit-like arrangement in the gore with a flap on one side of the slit having a piece of Velcro fastening material and overlaying a mating piece of Velcro material sewn along the other side of the slit. Thus, for entrance into or egress from the interior space of the inflated enclosure, a person may pull apart the two lips of the slit-like structure which are otherwise fastened together by the engagement of the two Velcro strips. Then, after passing through the slits, that person may then bring the opposed strips of Velcro material back together to hold the entranceway 18 closed.

As shown in FIG. 1, the upper portion 8 of the inflated enclosure bulges slightly outwardly of the periphery of the floor portion 12, to which the upper portion 8 is attached by its attachment to the mesh vent strip 10. Thus, when the enclosure is deflated, the upper portion 8 will tend to lie atop and generally radially outward of that vent strip 10, thus reducing the escape to the outside environment of any air introduced into the interior of the structure by the blower 4. As the structure becomes fully inflated, the upper portion assumes the shape generally illustrated in FIG. 1 and then lifts a portion of the mesh vent strip 10 off of the surface 20 on which it has been resting. This lifting serves to expose the mesh vent strip 10 to the surroundings and thus facilitates exhausting of the pressurized air from the sides of the structure through this open mesh. Since this mesh 10 is provided adjacent the base of the inflated structure, the amount of inflation of the enclosure tends to be limited to the amount necessary to expose a sufficient portion of the vent strip to permit exhausting of only the excess amounts of air introduced by the blower 4 into the enclosure interior. That is, if additional air is introduced, a larger venting area of the mesh material will tend to be exposed, permitting faster exhausting of the air, while little or no interior air will be exhausted until the structure is substantially filled to its standard inflated configuration. Thus, this vent strip 10 serves both as an automatic pressure regulating means to prevent overinflation of the enclosure and also as means for exhausting stale air from the interior of the structure to provide for continuous, self-ventilation.

As noted above, the material comprising the upper portion 8 of the inflatable structure is suitably a ripstop nylon. Additionally, it is preferably translucent to permit the entry of a limited amount of diffused light into the interior of the structure. Preferably, this translucent nylon material is of a blue color to provide a diffused blue light to the interior, which has been found soothing and conducive to concentration by students. For entry of additional light, one or more windows 22, suitably of transparent plastic sheet material, may be provided around the upper portion 8 of the enclosure. In this embodiment, a cupola 24, suitably also of transparent plastic material, is provided projecting above and attached adjacent the periphery of an aperture formed in the top of the upper portion 8 of the enclosure. This cupola 24 provides for entry of additional light and is dimensioned to permit a person, such as a teacher, within the structure to observe surrounding activities outside the structure by inserting his or her head into the cupola 24 and looking about.

To adapt the inflatable enclosure for activities such as the enclosed viewing of moving pictures or film strips, a reflective projecting screen 26 may suitably be applied to a part of the interior surface of the upper portion 8 of the enclosure. Such a projection screen suitably may be applied by silkscreen techniques using preferably a reflective white paint or ink. To further facilitate this use for projection of still or moving pictures, access is provided to the interior of the structure by projecting unit placed outside the structure, such as being placed upon the carrying case 2, as shown. Such access suitably may be provided by a tubular sleeve or cone 28 sewn about an aperture in one of the gores 14 on the upper portion 8 of the structure. This sleeve or cone 28 is preferably of a larger internal diameter than the diameter of a projector lens to be inserted thereinto and is provided with adjustable closure means such as two mating strips 30 of Velcro material each sewn about an opposing half of the outermost end of the sleeve 28. Thus, such Velcro fastening strips 30 may be pulled apart for insertion of the lens of a projector 32 (FIGS. 1 and 2) into the sleeve 28 and may then be closed up around the lens by pinching the Velcro strips back together, thus, substantially eliminating air loss around the lens from the interior of the inflated structure. Suitably, this sleeve 28 is positioned in a gore diametrically opposite the position of the screen 26 so that pictures may be projected onto the screen while leaving the projector 32 outside the enclosure. As illustrated in FIGS. 1 and 2, the sleeve 28 suitably may also be positioned directly about the conduit 6 so that the projector 32 may be placed atop the blower housing/carrying case 2.

While the inflatable enclosure of this invention is utilized in its inflated condition, illustrated in FIGS. 1 and 2, an additional benefit is provided in its self-contained storage arrangement, illustrated in FIGS. 4–6. This arrangement comprises the provision of asingle case 2 serving as both the blower housing and as a storage receptacle for the inflatable structure. This blower housing/carrying case 2 suitably comprises a rectangular box open an one end and having sides 34 formed of a suitable material such as plywood and fiberglass. Inside the carrying case, and adjacent the back end thereof, a blower 4, suitably in the form of an electrically operated axial fan is mounted to provide a flow of air axially toward the conduit sleeve 6, which is attached to a ring 36 surrounding an aperture in a bulkhead 38 directly in front of the blower 4. A grill or screened opening 40 is provided directly behind the blower for supplying outside air to the blower and thence into the interior of the inflatable enclosure. To prevent injury either to children playing around the carrying case or to the inflatable enclosure adjacent the carrying case, suitable padding 42 is provided surrounding the open end of the carrying case through which the conduit 6 passes. This padding may be of any suitable type such as synthetic foam, covered by nylon or other suitable material. Similar padding 44 may desirably be provided at the rear of the carrying case 2 to protect against injury by contact with other corners of the carrying case.

After the activity for which the inflatable enclosure is used has been completed, it is desirable to remove the enclosure to free the area upon which it was erected for other use, especially since the enclosure may suitably be approximately 10 feet in diameter and about 5 feet high. At this point, another of the benefits of this invention becomes apparent. The user of the structure simply turns off the inflating blower 4, either by operating the switch 46 or by unplugging the electric cord 48 which supplies power to the blower. Concurrently, the entranceway 18 may be pulled open to allow rapid ventilation of the inflating air held within the enclosure. As soon as the upper portion 8 of the enclosure has collapsed with substantially all of its inflating air having been exhausted therefrom, the enclosure may then be folded and rolled into a compact bundle, as illustrated in FIG. 5. This bundle may then be rolled into and stored in the portion of the carrying case 2 ahead of bulkhead 38. Preferably, the conduit 6 which is attached to the upper portion 8 of the enclosure, remains attached to the ring 36 by means of an elastic member extending thereabout, except when it is desired to remove the fabric enclosure and conduit for cleaning. After the enclosure has been rolled up and inserted into the carrying case, the end cover 16, formed suitably of a fabric such as nylon, may be brought over the open end of the carrying case and attached, suitably by means of Velcro fastening strips attached to the cover 16 joining with mating strips affixed to the carrying case end cushion 42, as illustrated in FIG. 6. In this configuration, the structure is completely encased for ready portability by the carrying handle 52, attached to the carrying case.

While the foregoing provides a detailed description of one particularly preferred embodiment of the structure of this invention, it is to be understood that this description is illustrative only of the principles of the invention and is not to be considered limitative thereof. Since numerous modifications and variations, all within the scope of this invention, will readily occur to those skilled in the art, the scope of this invention is to be limited solely by the claims appended hereto.

What is claimed is:

1. A portable, self-ventilating inflatable enclosure assembly for providing a separate, completely enclosed space, defined by the interior of the enclosure, within a room, comprising an enclosure floor portion of flexible sheet material for contacting the surface supporting the structure, the periphery of said floor portion defining the base of said enclosure, an enclosure upper portion of flexible sheet material attached to said floor portion adjacent said floor portion periphery, the space between said floor portion and said upper portion defining the interior space of the enclosure, blower means for supplying air at a predetermined rate at greater than ambient pressure to fill said enclosure interior space therewith, whereby the enclosure may be inflated, conduit means joining said blower means to said enclosure interior for introduction of said supplied air into said interior, vent means positioned adjacent the attachment of said upper portion to said floor portion providing for automatic venting of said supplied air from said enclosure interior space at a predetermined rate after said enclosure is fully inflated, and a carrying case containing said blower means and into which said floor portion, upper portion, conduit means and vent means are insertable for carrying when the enclosure is deflated.

2. The assembly of claim 1 wherein said conduit means is attached both to said enclosure upper portion and to said carrying case adjacent the output side of said blower means, whereby the enclosure upper portion, floor portion and vent means all are both attached to and insertable into the carrying case.

3. The assembly of claim 1 wherein said vent means comprises at least one elongated strip of open mesh material interposed between and joining at least a part of said upper portion to said floor portion periphery such that full inflation of said enclosure interior space serves to lift said mesh generally out of contact with said supporting surface, whereby full inflation of the interior space of the structure serves to open the mesh vent means to permit controlled venting of the supplied air from the enclosure interior space to the outside environment, thus also ventilating the enclosure interior.

4. The assembly of claim 1 wherein said floor portion is generally circular and said upper portion is generally dome-shaped.

5. The assembly of claim 3 wherein the maximum lateral dimension of said upper portion is located between said floor portion attachment and the top of said upper portion, whereby the upper portion bulges outwardly above the floor portion attachment.

6. The assembly of claim 1 wherein said upper portion sheet material is generally translucent, whereby light from outside the enclosure may be diffused into the structure interior.

7. The assembly of claim 6 wherein said upper portion sheet material is blue in color.

8. The assembly of claim 6 further comprising a window of transparent material attached to an aperture in said translucent material.

9. The assembly of claim 1 further comprising a cupola of transparent material projecting above and attached adjacent the periphery of an aperture formed in the top of said upper portion, whereby light may be admitted to the interior of the enclosure therethrough, and a person within said enclosure interior may observe the outside surroundings from within the transparent cupola.

10. The assembly of claim 1 further comprising a tubular sleeve which projects outwardly of said enclosure upper portion and includes at its outer end a selectively openable and closable aperture of adjustable size whereby that aperture may be opened to permit partial insertion of an object from outside and then may be closed about that partially inserted object.

11. The assembly of claim 10 further comprising a light-reflective image projection screen formed upon a part of the interior surface of said enclosure upper portion generally opposite said aperture and tubular sleeve.

12. The assembly of claim 1 further comprising selectively openable and closable slit-type entrance means provided in said enclosure upper portion, whereby, when the entrance means is opened, access may be had into the interior of the enclosure and, when the entrance means is closed, it resists the escape therethrough of the pressurized air supplied to the interior of the enclosure.

* * * * *